US005202697A

United States Patent [19]

Bonebright et al.

[11] Patent Number: 5,202,697

[45] Date of Patent: Apr. 13, 1993

[54] LOW-PROFILE STEERABLE CARDIOID ANTENNA

[75] Inventors: Mark E. Bonebright, La Mesa; Bernard Berkowitz, San Diego, both of Calif.; James Boelens, Arlington, Tex.

[73] Assignee: Cubic Defense Systems, Inc., San Diego, Calif.

[21] Appl. No.: 642,842

[22] Filed: Jan. 18, 1991

[51] Int. Cl.[5] ..... H01Q 13/10

[52] U.S. Cl. ..... 343/770; 343/768; 343/708

[58] Field of Search ..... 343/770, 769, 767, 708, 343/768, 789, 850, 862, 876

[56] References Cited

U.S. PATENT DOCUMENTS

| | | | |
|---|---|---|---|
| 3,312,976 | 4/1967 | Gregory | 343/770 |
| 3,757,344 | 9/1973 | Pereda | 343/770 |
| 3,805,266 | 4/1974 | Fletcher et al. | 343/708 |
| 3,810,183 | 5/1974 | Krutsinger et al. | 343/708 |
| 3,971,032 | 7/1976 | Munson et al. | 343/770 |
| 4,017,864 | 4/1977 | Proctor | 343/767 |
| 4,242,685 | 12/1980 | Sanford | 343/770 |
| 4,431,998 | 2/1984 | Finken | 343/797 |
| 4,733,245 | 3/1988 | Mussler | 343/769 |
| 4,803,494 | 2/1989 | Norris et al. | 343/770 |

OTHER PUBLICATIONS

King et al., "A Shallow Ridged-Cavity Crossed-Slot Antenna for the 240 to 400 MHz Frequency Range", IEEE Trans. Antenna Propagat. vo. AP-23, Sep. 1975.

"A Flush-Mounting Multi-Modal Antenna", Navy Technical Disclosure Bulletin, vol. 8, No. 2, Dec. 1982, Navy Case No. 65,404.

"A Shallow-Cavity UHF Crossed-Slot Antenna", IEEE Trans. Antennas Propagat. vol. AP-17, No. 5, Sep. 1969, pp. 558-563.

"A Compact Flush-Mounting Antenna With Direction Finding and Steerable Cardioid Pattern Capability", IEEE Trans. Antenna Propagat., vol. AP-32.

"Flush-Mounting Antenna System", Navy Technical Disclosure Bulletin, vol. 2, No. 8, 1977k Navy Case No. 61,254.

"Slot-Monopole Antenna System for Energy-Density Reception at UHF", IEEE Trans. Antennas Propagat., vol. AP-27, No. 4, Jul. 1979, pp. 485-488.

DF-301 E Direction Finder Data Sheet by Rockwell International Data Sheet No. DS-01-43.01.

"Design Data for Small Annular Slot Antennas", IRE Trans. Antennas Propagat., vol. AP-6, No. 4, Apr. 1958, pp. 210-211.

"Stacking Resonators to Increase the Bandwidth of Low-Profile Antennas", IEEE Trans. Antennas Propagat. vol. AP-35, No. 12, Dec. 1987, pp. 1473-1476.

*Primary Examiner*—Rolf Hille
*Assistant Examiner*—Hoanganh Le
*Attorney, Agent, or Firm*—Brown, Martin, Haller & McClain

[57] ABSTRACT

A multimode low-profile avionics antenna is disclosed for use in Automatic Direction Finder (ADF) systems. The low profile antenna generates a steerable cardioid radiation pattern having a minimum bandwidth of 30% and an unusual degree of independence from mutual coupling and coupling to ground-plane currents. The antenna includes two resonant cavity-backed slot antennas. The upper cavity, which backs a directional crossed-slot antenna, is the larger of the two cavities. The shallow lower cavity is actually a short-circuited radial transmission line employing a stepped inner radius and band-switching to extend the operating bandwidth to the required 30%. The crossed-slot antenna elements are configured orthogonally and the slot ends are folded over the side of the cylindrical cavity to minimize the resonant cavity diameter for the requisite slot length. The slot width is stepped open at the crossover point to enhance antenna bandwidth and to provide for greater spacing between the symmetrically-located feedpoints. The shallow circumferential slot antenna is equipped with two band-switched inductances for wider bandwidth. The two stacked cavities have a combined height of less than 0.1λ at the operating frequency and are suitable for use as a flush-mounted aircraft or helicopter ADF antenna.

8 Claims, 6 Drawing Sheets

| | | | | | | | | |
|---|---|---|---|---|---|---|---|---|
| 100 | 0° | -45° | -90° | -135° | -180° | -225° | -270° | -315° |
| 96 | 0° | -45° | -90° | -135° | -180° | -225° | -270° | -315° |
| 66<br>68 | 0°<br>-180° | -45°<br>-135° | -90°<br>-90° | -135°<br>-45° | -180°<br>0° | -225°<br>-315° | -270°<br>-270° | -315°<br>-225° |
| X-SLOT PHASORS | | | | | | | | |
| X-SLOT PATTERN | | | | | | | | |
| 106 | 360° | -315° | -270° | -225° | -180° | -135° | -90° | -45° |
| 102 | -90° | -45° | 0° | -315° | -270° | -225° | -180° | -135° |
| 70<br>72 | -90°<br>-90° | -45°<br>-135° | 0°<br>-180° | -315°<br>-225° | -270°<br>-270° | -225°<br>-315° | -180°<br>0° | -135°<br>-45° |
| Y-SLOT PHASORS | | | | | | | | |
| Y-SLOT PATTERN | | | | | | | | |
| CROSSED-SLOT PATTERN | | | | | | | | |

FIG. 11

LOW-PROFILE STEERABLE CARDIOID ANTENNA

BACKGROUND OF THE INVENTION

1. Field of the Invention

The present invention involves generally a multimode Ultra-High Frequency (UHF) antenna having a steerable cardioid radiation pattern with application to Automatic Direction Finding (ADF) systems and, more specifically, a multimode avionics ADF antenna having two efficient concentric cavity-backed slot radiators with an electronically rotatable cardioid combined radiation pattern.

2. Description of the Related Art

The primary application of our invention is for use as an Automatic Direction Finding (ADF) antenna for the 225–300 MHz Ultra-High Frequency (UHF) communications band. As is well-known in the art, an ADF antenna must provide a non-ambiguous directionality that is either electrically or mechanically steerable and should meet this requirement for both transmit and receive modes. A typical ADF antenna known in the art exhibits a steerable cardioid radiation pattern that is defined according to the formula $R=1+\cos\beta$, where R is the radiation signal sensitivity and $\beta$ is the direction angle, with respect to the direction of peak radiation signal sensitivity, in which R is measured.

The classical ADF antenna design employs a simple dipole to generate an ambiguous figure-eight pattern ($R=|\cos\beta|$). This simple ADF antenna design is well-known in the art but suffers from three distinct disadvantages. Firstly, the directional sensitivity of the simple dipole is ambiguous, which means that the operator is unable to determine whether his target is at 0° or 180° without moving the antenna and making a second measurement. Secondly, the classical dipole protrudes significantly above the ground plane, making it unsuitable for use with aircraft or missiles. Finally, the conventional ADF systems have relatively low gain (as low as 20 dBi in some parts of the band). This low gain is unacceptable for position locating system applications because the ADF reception performance must provide high efficiency to overcome the low transmitter power (100 mW) provided in the typical survival radial set.

There has been a strongly-felt need for an ADF antenna having a low profile suitable for mounting on the airfoil surfaces of missiles and aircraft. Many practitioners in the art have labored to develop low profile airfoil antennas for a variety of applications. For instance, the slot antenna backed by a resonant cavity is well-known in the art and can be mounted flush with an airfoil surface for a broad range of purposes.

The slot antenna is a cavity resonator, energized by a coaxial feeder, that radiates from a slot aperture in the active transmit mode. The field distribution in the slot therefore is dependent on the excitation of higher cavity modes as well as the principle mode ($TE_{10}$). To maximize the radiation conductance, the cavity dimensions must be large enough so that the dominant mode is above cutoff. The important design parameter, antenna Q (Quality Factor), is at a minimum when the stored energy in the cavity is only in the dominant mode. The Q limits the inverse voltage-standing-wave-ratio (VSWR) bandwidth product. For a small cavity, $Q>3/4\pi^2V$, where V is cavity volume in cubic wavelengths. The cavity resonant frequency can be lowered by using dielectric or ferrite loading of the cavity. A reduction in cavity volume and aperture size results in increased Q, smaller bandwidth, and lower efficiency. This means that a cavity-backed slot antenna having good efficiency and bandwidth requires a larger cavity volume, which increases the space and protrusion requirements in airfoil applications. A cavity-backed slot antenna functions with similarly directionality and efficiency in the passive receive mode.

Accordingly, practitioners in the art have sought to improve the cavity-backed slot antenna by incorporating changes within the cavity and by using novel slot geometries to increase operating bandwidth and antenna efficiency for low cavity volumes. For instance, H. E. King and J. L. Wong disclose a shallow, ridged-cavity, crossed-slot antenna for the 240–400 MHz frequency range (*I.E.E.E. Trans. Antennas Propagat.*, vol. AP-23, no. 5, September 1975, pp. 687–689). King and Wong demonstrated that a ridged-cavity slot antenna is a viable approach to achieving a wideband VSWR response. Their measurements showed that the ridged-cavity slot antenna also exhibits broadband pattern performance, although the radiation pattern characteristics are sensitive to the vehicle configuration when the slot is mounted on an aircraft. King and Wong neither teach nor suggest any method for isolating the antenna pattern from these airframe coupling effects. Indeed, they conclude that accurate pattern and directivity information will require model measurements.

H. Paris Coleman and Billy D. Wright, two researchers at the Naval Research Laboratory, have also considered the problem of flush-mounting an antenna for ADF applications. Coleman and Wright disclose a flush-mounted cavity-backed slot antenna using two concentric annular slots (*I.E.E.E. Trans. Antennas Propagat., vol. AP*-32, no. 4, April 1984, pp. 412–414). This dual annular slot antenna provides a good front-to-back ratio in a steerable cardioid pattern over a wide range of elevation angles. Unfortunately, the dual annular design, while smaller than other flush-mounted or low-profile transponder antennas, provides an operating bandwidth of only six percent. Also, the antenna is strongly coupled to the airframe so that pattern performance is strongly dependent on ground-plane configuration. Coleman and Wright neither teach nor suggest means for increasing the operating bandwidth or decoupling the dual annular slot radiators from the ground-plane geometry.

The problem of limited bandwidth in low-profile cavity resonators was addressed by H. K. Smith and Paul E. Mayes (*I.E.E.E. Trans. Antennas Propagat., vol. AP*-35, no. 12, December, 1987, pp. 1473–1476) by stacking two cavity resonators to increase the effective bandwidth. Smith and Mayes suggest stacking resonators with similar resonant frequencies and coupling energy between the cavities by means of carefully-placed slots in the common wall. They propose a dual cavity-backed slot antenna consisting of two D-shaped cavities stacked one above the other, coupled by two slots in the common wall. However, Smith and Mayes neither teach nor suggest methods for applying their stacking and coupling technique to the problems inherent in ADF antennas using steerable cardioid patterns nor do they consider ground-plane decoupling to preserve pattern performance.

The omnidirectional circumferential slot antenna is also well-known in the art. In U.S. Pat. No. 3,739,386, Howard S. Jones, Jr., discloses the use of a plurality of concentric ring radiating elements in a space projectile for telemetry and other applications. Jones, Jr., teaches the use of concentric ring radiators backed by a single resonant cavity as well as a plurality of stacked cavity backed circumferential radiating slot antennas. In U.S. Pat. No. 3,805,266, Robert E. Munson discloses a novel turnstile slot antenna which makes use of a circumferential slot around a prismatic spacecraft body for use in telemetry and command communications. In U.S. Pat. No. 3,810,183, Jack K. Krutsinger, et al., disclose a dual slot antenna assembly including a pair of concentric, radially-spaced cylindrical conductors defining a pair of circumferential slots which are longitudinally spaced one-half wavelength apart. None of these disclosures teach or suggest the use of the omnidirectional circumferential slot radiator in ADF applications requiring a steered directional antenna pattern nor do they teach or consider solutions to the bandwidth and ground-plane coupling problems common to all reduced-size slot antennas.

Other methods have been proposed by practitioners in the art for improving the bandwidth and efficiency of slot radiator antennas at reduced cavity sizes. For instance, U.S. Pat. No. 4,242,685, issued to Gary G. Sanford, discloses a resonant cavity-backed slot radiating antenna that includes an electrically-conducting plate disposed within the cavity, having no contact with internal cavity walls, to effectively lengthen the electrical dimensions of the cavity and thereby reduce the resonant frequency. Sanford's technique provides a more efficient antenna structure and reduces the requisite physical dimensions for operation at a given frequency, but Sanford neither teaches nor suggests isolation methods to minimize the effects of airframe geometry on the antenna radiation pattern. Also, Sanford's technique does little to increase antenna bandwidth.

In U.S. Pat. No. 4,431,998, Kenneth R. Finken discloses an antenna configuration for shaped-conical or uniform hemispheric coverage using circularly-polarized signals. Finken's antenna is a very thin or flush-mounted radiation structure using an array of elements providing circular polarization. Finken's design emphasizes ease of control over pattern shape and neither teaches nor suggests solutions to the problems of pattern distortion from mounting frame coupling and narrow antenna bandwidth.

In U.S. Pat. No. 4,733,245, Michael E. Mussler discloses an electrically-small, cavity-backed slot antenna having an elongated slot disposed around the perimeter of the cavity-backed radiator surface. Mussler teaches the use of several elongated slot configurations, including substantially rectangular, substantially triangular and circular, as means for reducing the requisite physical size of the cavity resonator without shortening the slot length and thereby unduly sacrificing antenna performance. Although Mussler's teachings do reduce cavity resonator size, he neither teaches nor suggests solutions to the problems of pattern distortion from airfoil coupling and narrow antenna bandwidth.

These unresolved problems and deficiencies are clearly felt in the art and are solved by our invention in the manner described below.

SUMMARY OF THE INVENTION

The primary object of our invention is to provide an efficient, compact antenna system for ADF applications, having a steerable cardioid radiation pattern and a 30% or greater operating bandwidth, suitable for mounting on a helicopter airframe without degradation of the cardioid pattern. An advantage of our invention is that the antenna cavity depth is shallow (less than 0.1λ), which facilitates practical mounting on a helicopter or aircraft.

We use a crossed-slot, cavity-backed antenna to provide a high-gain, figure-eight dipole radiation pattern and we stack this antenna on a second cavity-backed circumferential slot antenna having a coherent omnidirectional radiation pattern to provide a signal for resolving the figure-eight ambiguity. Because both resonators have a common azimuthal phase center, the combination of these two cavity antennas provides the coherent signals necessary for a steerable cardioid pattern. The upper cavity, which backs the directional crossed-slot antenna, is the larger of the two and is sized to sparingly satisfy the theoretical minimum volume required for a 30% bandwidth. The shallow lower cavity is actually a short-circuited radial transmission line. We employ a stepped inner radius and band-switching to extend the lower omnidirectional radiator bandwidth to the required 30%. The outer radius of the radial transmission line is terminated in a circumferential slot, which radiates in an omnidirectional mode. This cavity-backed circumferential slot acts as a choke to isolate the upper crossed-slot cavity radiator from the undesired effects of coupling to the standing-wave currents present on the aircraft skin. This isolation is an unanticipated advantage of the concentric aperture configuration and avoids a well-known difficulty with slotted antennas. The coupling effect on the omnidirectional circumferential slotted antenna does not affect the directional performance of the combination because the omnidirectional function is not critical to antenna sensitivity.

In our upper crossed-slot antenna, the crossed slots are lengthened to approximately 0.7λ for improved efficiency by folding the slot ends over the sides of the cavity. These slots may also be extended around the circumference of the cavity in a manner known in the art to the same effect. A stepwise increase in slot width at the slot crossover point enhances the radiator bandwidth and allows the diagonal feed points to be moved further apart for a better feed-line impedance match with the slots.

Our crossed-slot antenna feed network is a modified Butler matrix known in the art. The Butler matrix produces counter-rotating, circularly-polarized signals so that the upper antenna is normally vertically-polarized at the horizon and the phase center of the antenna is stationary during the scanning process. The VSWR remains below 3:1 over the 30% operating bandwidth without special measures for improving the impedance match conditions at the crossed-slot ports.

The foregoing, together with other features and advantages of our invention will become more apparent when referring to the following specifications, claims and accompanying drawings.

For a more complete understanding of our invention, reference is now made to the following detailed description of the embodiments, illustrated in the accompanying drawings, wherein:

FIG. 11 is a chart showing the phasor relationships among the Butler matrix output signals for the crossed-slot antenna.

DESCRIPTION OF THE PREFERRED EMBODIMENTS

Figure 1:
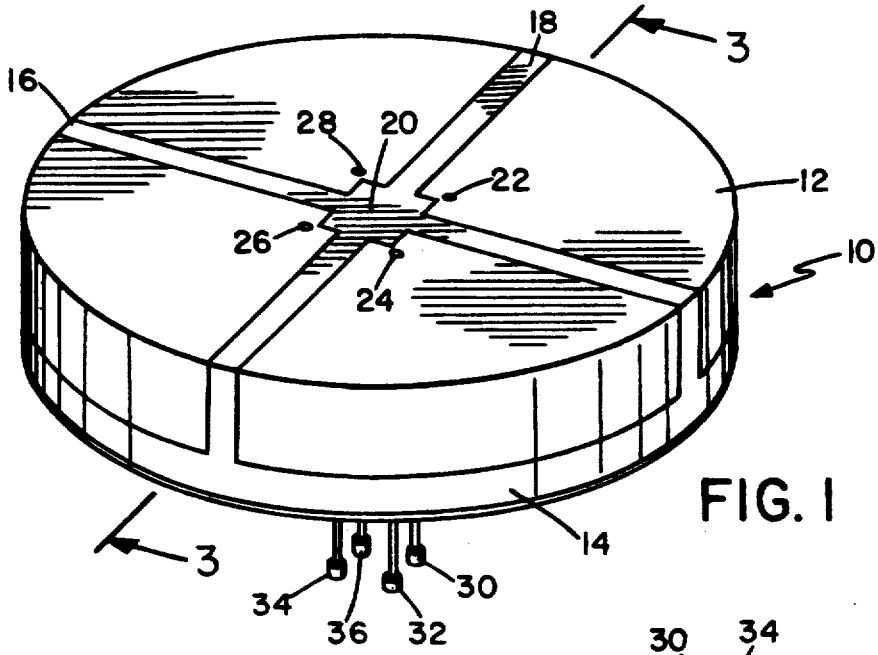
FIG. 1 is a perspective view of an illustrated embodiment of the ADF antenna from one side.

FIG. 1 shows the preferred embodiment of our ADF antenna 10. ADF antenna 10 includes an upper cavity-backed crossed-slot resonator 12 and a lower cavity-backed circumferential slot radiator 14. The crossed slots and circumferential slot in FIG. 1 are filled with a suitable dielectric material, such as teflon. The remainder of the cavity walls are made of a suitable conducting material, such as aluminum or copper.

A longitudinal slot 16 and another intersecting longitudinal slot 18 are disposed in the upper wall of crossed-slot radiator 12 as shown in FIG. 1. Slots 16 and 18 are folded over the sidewall of resonator 12 to gain additional length relative to the diameter of resonator 12. This slot-lengthening technique is particularly necessary for shallow cavities because the potential minor lobes near the slot axes are masked by the second orthogonal slot as a result of the slot length exceeding $\lambda/2$.

Figure 2:
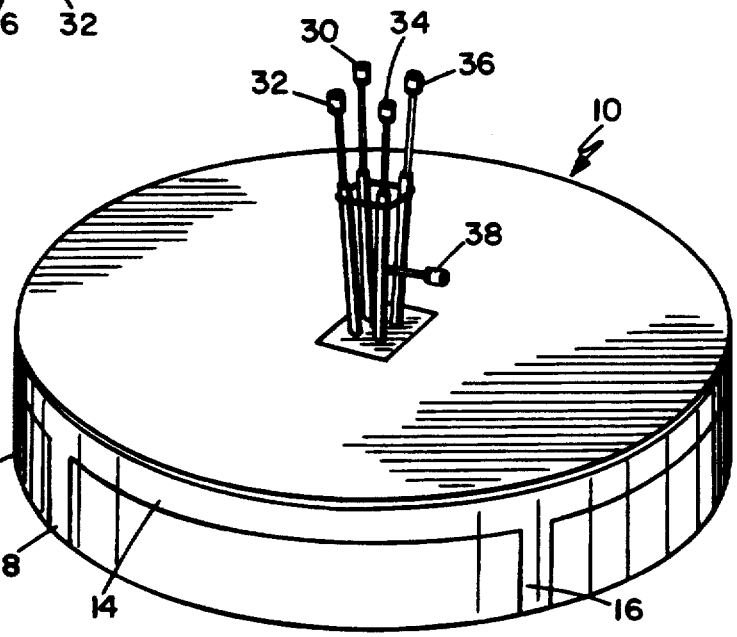
FIG. 2 is a perspective view of the antenna in FIG. 1 from the opposite side.

Slots 16 and 18 are shown with a stepped increase in width at the region 20 where the two slots cross. This stepped slot width at region 20 both enhances the bandwidth and better locates the four diagonal feedpoints 22, 24, 26 and 28 for the requisite match of the slot impedance to the line impedance. Feedpoints 22–28 are energized by means of RF signals inserted at the RF connectors 30, 32, 34 and 36 as shown in FIGS. 1 and 2. Feeding slots 16 and 18 on the diagonal tends to decrease the mutual coupling of the slots, creating "virtual" slots at 45° to the physical slots. In FIG. 2, the RF connector 38 is used to feed circumferential slot radiator 14.

Figure 4:
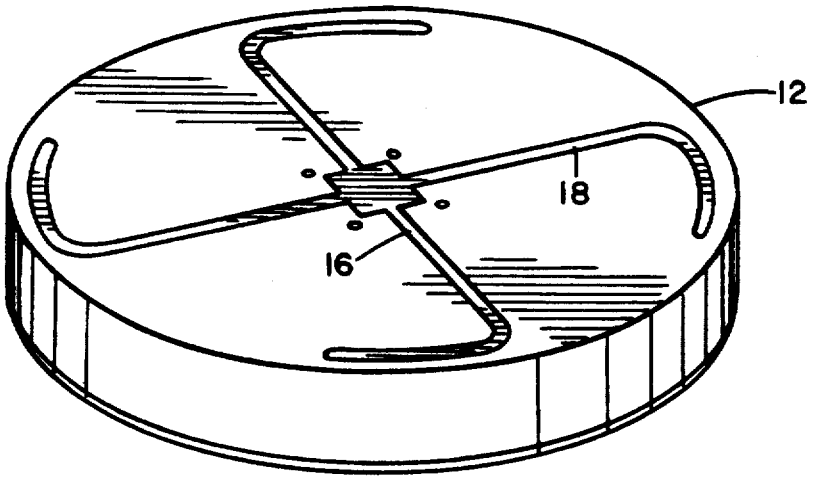
FIG. 4 is a view of an alternate elongated-slot configuration for the crossed-slot radiator.

FIG. 4 shows an alternate embodiment where slots 16 and 18 are lengthened by curving the ends of the slots and routing them within the circumference of the upper wall of crossed-slot radiator 12. Other features of the alternate embodiment shown in FIG. 4 are similar to those of the preferred embodiment shown in FIG. 1.

Figure 3:
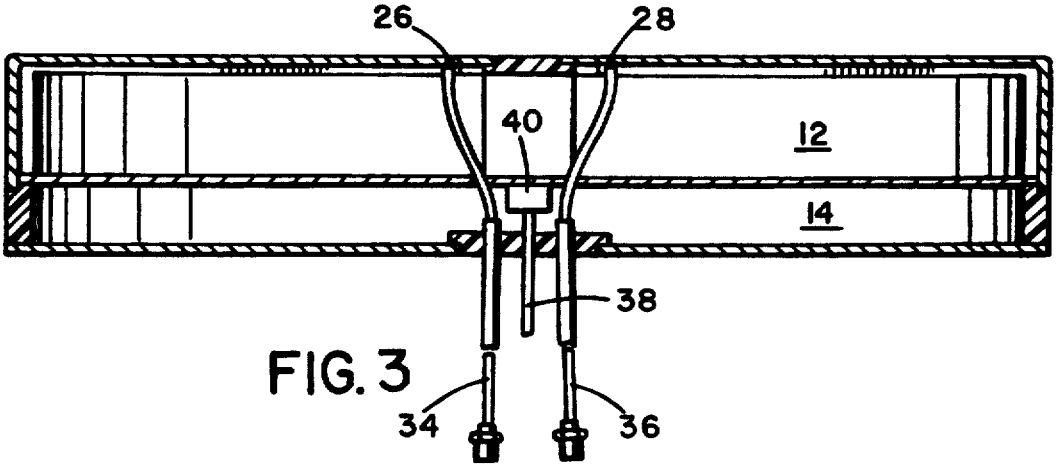
FIG. 3 is an enlarged sectional view taken on line 3—3 of FIG. 1.

FIG. 3 illustrates the internal signal routing from RF feed connectors 34 and 36 to feedpoints 26 and 28. RF connector 38 is shown terminating in a matching network 40 from which the input (not shown) to resonator 14 is provided. The generic design of circumferential slot resonator 14 is a flush, annular slot backed by a thin, cylindrical cavity with a half-wavelength diameter. Because there is no room for the relatively large-diameter cavities beneath the skin of an aircraft, the two cavities are externally stacked with a total height of less than $0.1\lambda$. Resonator 14 is allotted less than half this depth.

In theory, the resulting cavity volume of resonator 14 is too small to support the 30% bandwidth requirement without some form of band-switching. While the performance parameters of radiator 14 are not critical in the receive mode, reasonable efficiency is required in the transmit mode. Also, any active devices used in band-switching must be protected from electrical overload. Because circumferential slot resonator 14 is located at the base of a short cylinder, it may also be considered as a short, heavily top-loaded monopole. Consequently, there are two possible approaches to the solution of the broadband matching problem for circumferential slot resonator 14.

The first approach is to consider resonator 14 to be a short, capacitively-loaded monopole. Because of the extremely small length-to-diameter ratio when viewed as a monopole, especially with capacitive loading as a complication, a matching network design must be empirical. A basic matching-stub network design configuration is suitable for this first approach. The capacitive nature of circumferential slot resonator 14 is obvious.

Figure 5:
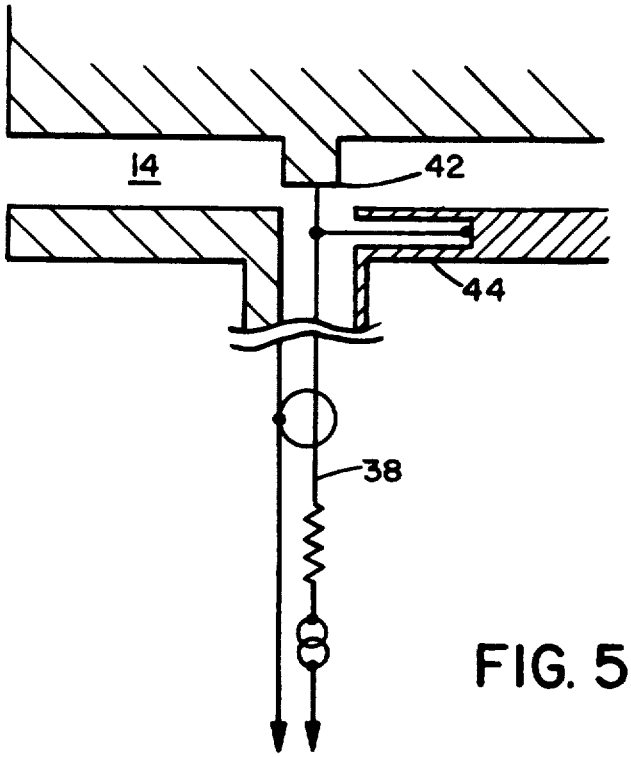
FIG. 5 is a schematic layout of a simplified embodiment of the circumferential radiator cavity showing a feed and a matching stub.
Figure 6:
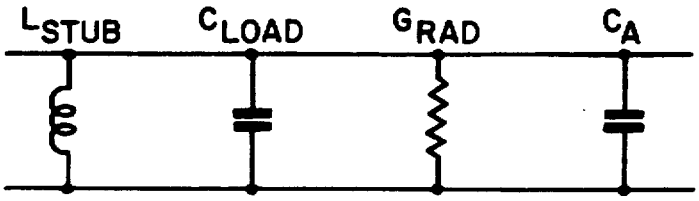
FIG. 6 is an equivalent circuit representation of the circumferential radiator schematic for FIG. 5.

FIG. 5 shows a simple schematic illustration of a slot on the circumference of a cylinder for the purposes of discussing this simple matching-stub tuning scheme. The shielded feedline 38 is shown terminated at the feedpoint 42 of resonator 14. A matching or tuning stub 44 is shown connected to feedpoint 42. FIG. 6 shows the equivalent circuit of this arrangement. $L_{STUB}$ is the equivalent reactance of tuning stub 44. $C_{LOAD}$ is the load capacitance and $G_{RAD}$ with $C_A$ represents the radiation impedance. The Q of the circuit in FIG. 6 is quite high, a factor of two or three times the required value for a 30% bandwidth. This means that at least two discretely different values of stub reactance are required to tune across a 30% band if the simple matching section 44 is used. If the two reactances are properly tuned, the resistive match should be adequate and the VSWR should be less than 4:1. This first simplistic approach to the matching of circumferential slot resonator 14 is useful only because resonator 14 phase behavior is not critical to the ADF antenna performance.

Figure 7:
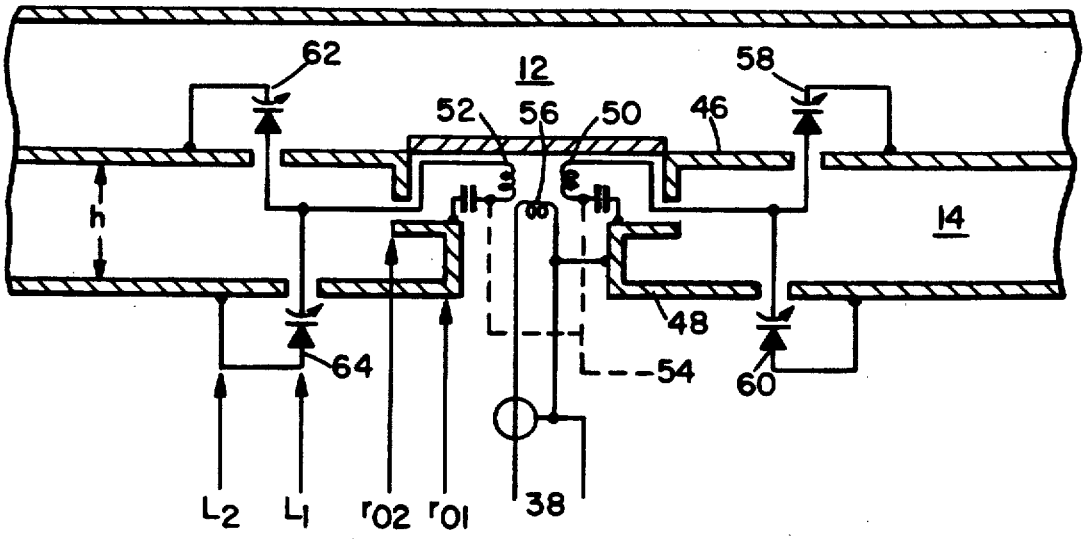
FIG. 7 is a schematic representation of the preferred embodiment of the circumferential slot feed showing a stepped cavity radius and a double-loop bandswitch.
Figure 8:
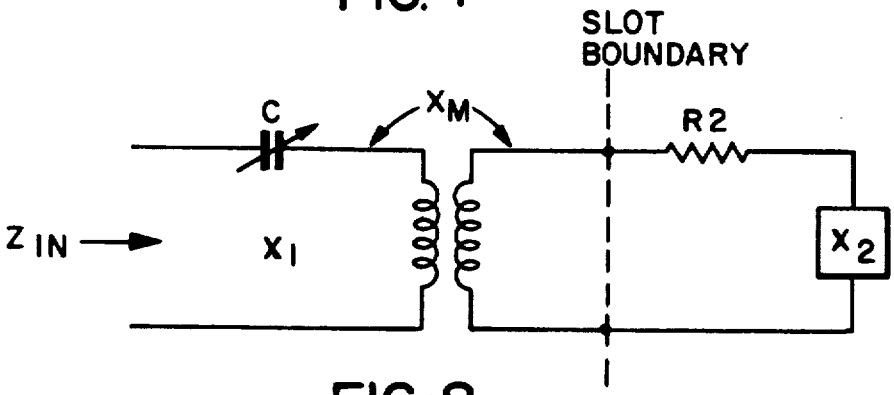
FIG. 8 is an equivalent circuit for the schematic shown in FIG. 7.

The second approach to solving the broadband matching problem for circumferential slot resonator 14 is to couple by way of a short-circuited radial transmission line. This approach to the matching problem is more conventional but also more complex. In theory, the greater number of degrees of freedom in parameter adjustment promises a better match and lower VSWR across the 30% band with this second approach. A cross-sectional schematic view of such a circumferential slot radial cavity is shown in FIG. 7. The radial transmission line is formed by the upper wall 46 and lower wall 48 as shown in FIG. 7. The inner radius $r_{01}$ of the radial transmission line is terminated in a short circuit to provide the conjugate inductive susceptance $b_t$ needed to tune out the capacitative slot susceptance $B_s$. FIG. 8 shows an equivalent circuit wherein the resulting residual reactance is $X_2 = -1/B_s + 1/B_t$. The slot radiation resistance is $R_2$.

The parallel loops 50 and 52 are switched in or out on a mutually exclusive basis by means of a switch bias current at 54. Only a single set of two loops is active over each half of the operating frequency band. That is, depending on switch bias current 54, loop 56 and loop 50 are active or loop 56 and loop 52 are active. Switch bias current 54 acts to change the capacitance of the varactor diodes 58, 60, 62 and 64. Changing the bias of diodes 58, 60, 62 and 64 provides both the required switching function at extreme bias and permits tuning of the inductances of parallel loops 50 and 52 as required.

The addition of a step in the cavity inner radius (from $r_{01}$ to $r_{02}$) increases the bandwidth of circumferential band slot resonator 14 by minimizing $X_2$. The cavity inner radius is stepped from $r_{01}$ to $r_{02}$ at the midway point as shown in FIG. 7. The analytical basis for this feature can be understood by referring to Cumming and Cormier, *IRE Trans. Antennas Propagat.*, vol. AP-6, no. 4, April, 1958, pp. 210–211.

Figure 9:
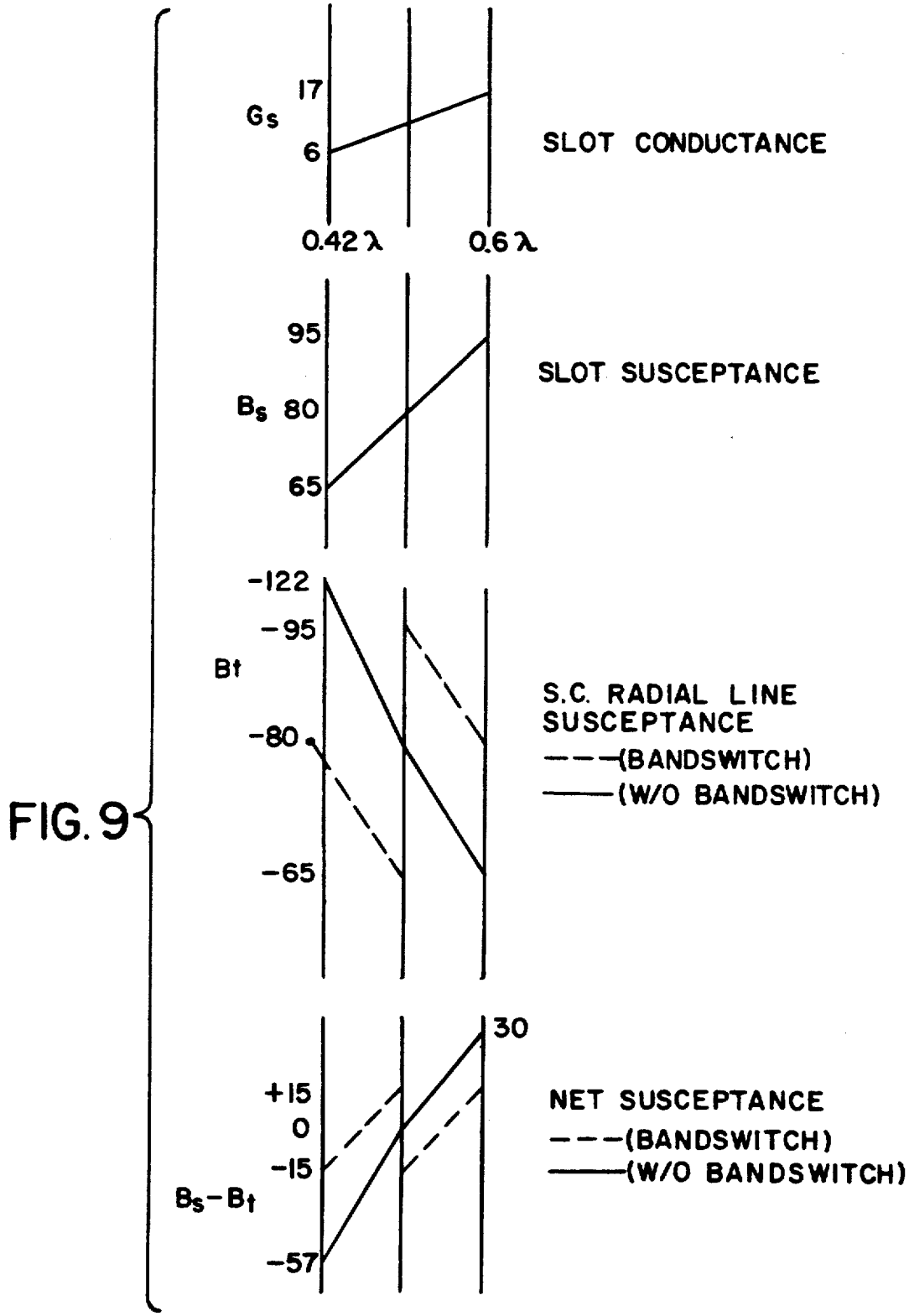
FIG. 9 is a graphical illustration of the bandswitch characteristics of the circumferential slot frequency response.

FIG. 9 shows the effect on slot susceptance of this second approach for solving the bandswitching problem. $G_s$ is the slot conductance in the operating frequency band, which varies from 6 mmhos to 17 mmhos across a band from 0.42λ to 0.6λ. $B_s$ is the slot susceptance, which varies from 65 mmhos through a mid-point of 80 mmhos to 95 mmhos across the same band. The short-circuited radial line susceptance provided by switched parallel-drive loops 50 and 52 in FIG. 7 is shown as $B_f$ with one of the loops represented by a solid line from −122 mmhos to about −65 mmhos, and the other represented by two dotted lines in the region from −95 mmhos to −65 mmhos. The net susceptance is shown as $B_s$–$B_f$ and the effect of bandswitching in mid-band is shown by the dotted lines in the ±15 mmhos. net susceptance region.

The presence of this bandswitched and tuned circumferential slot radiator 14 acts as a choke, which tends to isolate crossed-slot radiator 12 from the ground-plane or airframe. Such isolation should make the performance of crossed-slot radiator 12 independent of changes in ground-plane geometry. This effect was confirmed experimentally on a scale model in tests at one-eighth scale and is an unexpected advantage of our novel ADF antenna design. The coupling of radiator 14 to the ground plane does not materially affect the cardioid gain.

Figure 10:
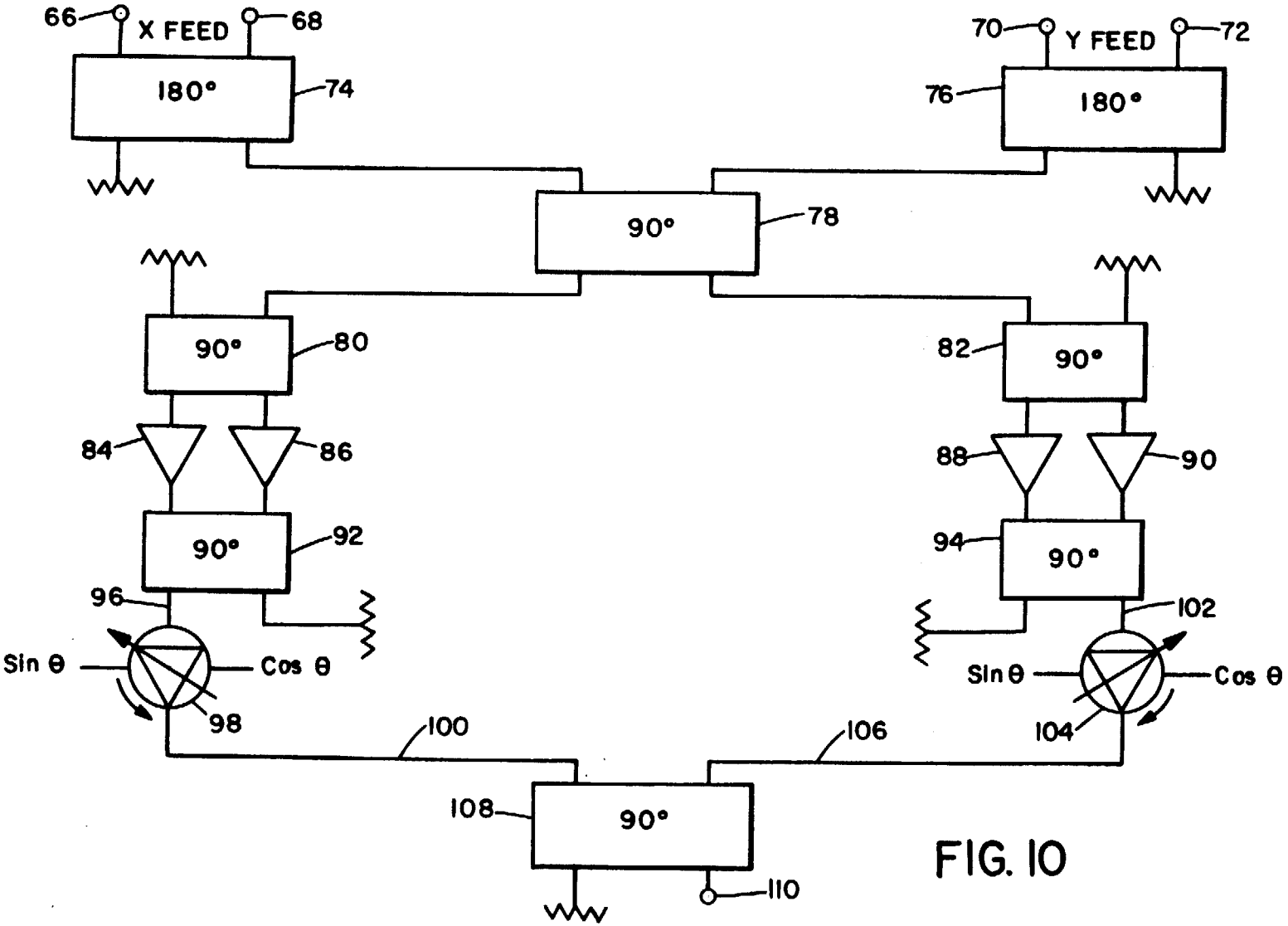
FIG. 10 is a schematic diagram of the Butler matrix crossed-slot feed network.

We now return to a discussion of crossed-slot antenna 12. FIG. 10 shows a schematic representation of the crossed-slot antenna feed network is based on the Butler matrix known in the art. The Butler matrix produces counter-rotating circularly-polarized signals so that crossed-slot antenna 12 is normally vertically-polarized at the horizon. As a corollary to this condition, the phase center of antenna 12 is stationary regardless of the orientation of the pattern during scanning. In FIG. 10, the first slot X-feed is shown as the two feed terminals 66 and 68. The second slot Y-feed is shown as the two feed terminals 70 and 72. These four terminals 66, 68, 70 and 72 are connected to diagonal feedpoint probes 22, 24, 26 and 28 shown in FIG. 1.

A coupling network 74 combines X-feed signals 66 and 68 while another coupling network 76 combines Y-feed signals 70 and 72. The outputs of networks 74 and 76 are routed through two additional levels of phase-shift and coupling networks 78, 80 and 82 as shown in FIG. 10 and thereafter are preamplified by preamplifiers 84, 86, 88 and 90. The preamplifier outputs are again coupled and shifted through networks 92 and 94. The output signal 96 from network 92 is dynamically rotated by a complex phasormodulator 98 to produce a phase-modulated signal 100. Output signal 102 from coupling network 94 is phase modulated by a complex phasor modulator 104 to form a first phase-modulated signal 106. Phase-modulated signals 100 and 106 are again coupled and shifted in network 108 and the resulting output signal 110 is in the final beamformed signal from crossed-slot antenna 12. Output signal 110 is then combined with the output signal from circumferential slot omnidirectional antenna 14 to form the final ADF antenna output signal (not shown) in a manner known in the art.

Although the Butler matrix beamforming technique is well-known in the art, we describe in FIG. 11 the effects of the operation of the circuit described in FIG. 10 as applied to our invention. The first section of FIG. 11 shows X-slot phase-modulated signal 100 as rotating from 0° to −315° in steps of 45°. Output signals 96, 66 and 68 are shown having the phase values resulting from operation of the Butler matrix network in FIG. 10. The resulting X-slot phasors and directivity pattern are shown schematically following the signal phase data. The second section of FIG. 11 provides similar information for Y-slot phase-modulated signal 106 and associated output signals 102, 70 and 72. The Y-slot phasors and directivity pattern schematics are then provided in steps of 45°. The last line in FIG. 11 shows the directivity pattern of crossed-slot antenna 10, which is a figure-8 dipole pattern moving in counter-clockwise rotation in 45° increments.

The modulation inputs to complex phasor modulators 98 and 104 in FIG. 10 are provided by the equivalent of two-phase resolvers, with RF vector rotation occurring in opposite directions as shown. Accordingly, the X- and Y-slots are excited with biphase $\sin\theta$ and $\cos\theta$ amplitudes, respectively, where $\theta$ is the scan or bearing angle with respect to the axis of maximum response. The phase dispersion error contributed by the multiple hybrid circuits of the feed network is limited to a few degrees RMS by tight component specifications and calibration of the assembly. The data in FIG. 11 demonstrates our contention above that the crossed-slot antenna has a fixed phase center during pattern rotation.

Figure 12:
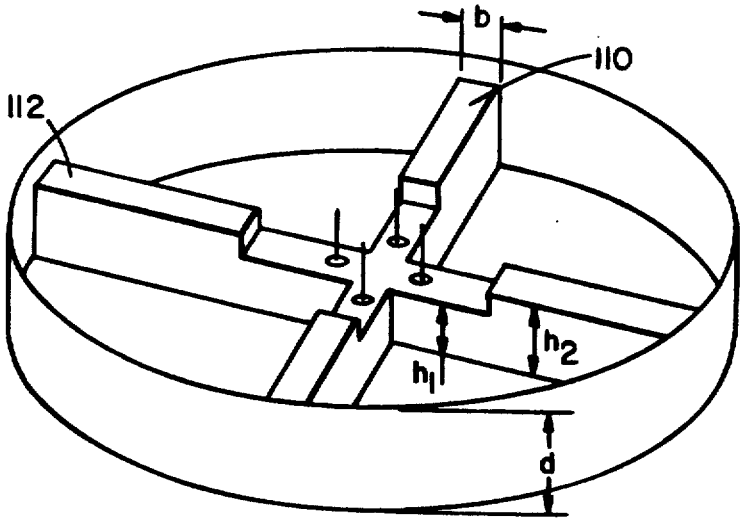
FIG. 12 is a cutaway view of an upper crossed-slot antenna resonant cavity.

FIG. 12 shows an alternative embodiment of the backing cavity for crossed-slot radiator 12. Two cavity ridges, 110 and 112 are shown, having stepped height in the vicinity of the ridge intersection. The ridges are arranged symmetrically with respect to the crossed-slots (not shown) as may be appreciated by referring to FIG. 1. Adding a ridge to resonator 12 provides additional degrees of freedom for flattening the VSWR response, which is very sensitive to variation in the ridge parameters in the upper portion of the operating frequency region. The advantages of using a ridged-cavity for a shallow crossed-slot antenna in this frequency range can be understood by referring to King and Wong, *IEEE Trans. Antennas Propagat.*, vol. AP-23, no. 5, September 1975, pp. 687–689.

Obviously, other embodiments and modifications of our invention will occur readily to those of ordinary skill in the art in view of these teachings. Therefore, our invention is to be limited only by the following claims, which include all such obvious embodiments and modifications when viewed in conjunction with the above specification and accompanying drawings.

We claim:

1. An antenna assembly comprising: a first resonant cavity having first and second opposing walls, with plural intersecting radiating slots disposed in said first wall;

a second resonant cavity disposed on said second wall having at least one circumferential radiating slot;

first feed means comprising at least four feed probes, one such feed probe located equidistant from symmetric points on said intersecting radiating slots for feeding radio-frequency energy to said first resonant cavity;

generating means connected to said feed probes for creating a plurality of circularly-polarized, radio-frequency signals with counter-rotating phases;

second feed means for feeding radio-frequency energy to said second resonant cavity; and said plural intersecting radiating slots being curvilinear and elongated to form a symmetrical curved configuration within the perimeter of said first wall.

2. An antenna assembly comprising: a first resonant cavity having first and second opposing walls, with plural intersecting radiating slots disposed in said first wall;

a second resonant cavity disposed on said second wall having at least one circumferential radiating slot;

first feed means comprising at least four feed probes, one such feed probe located equidistant from symmetric points on said intersecting radiating slots for feeding radio-frequency energy to said first resonant cavity;

generating means connected to said feed probes for creating a plurality of circularly-polarized, radio-frequency signals with counter-rotating phases; and second feed means for feeding radio-frequency energy to said second resonant cavity;

said plural intersecting radiating slots consisting of two orthogonally intersecting radiating slots, each said slot having a symmetrically stepped increase in width at the locus of intersection; and said plural intersecting radiating slots being curvilinear and elongated to form a symmetrical curved configuration within the perimeter of said first wall.

3. An antenna assembly comprising: a first resonant cavity having first and second opposing walls, with plural intersecting radiating slots disposed in said first wall;

a second resonant cavity disposed on said second wall having at least one circumferential radiating slot;

first feed means comprising at least four feed probes, one such feed probe located equidistant from symmetric points on said intersecting radiating slots for feeding radio-frequency energy to said first resonant cavity;

generating means connected to said feed probes for creating a plurality of circularly-polarized, radio-frequency signals with counter-rotating phases;

second feed means for feeding radio-frequency energy to said second resonant cavity; and said second feed means comprising a radial transmission line having at least one short-circuit termination disposed to cancel the electrical susceptance of said circumferential radiating slot.

4. The antenna assembly disclosed in claim 3, wherein said second feed means additionally comprises band-switching means for switching between two said short-circuit terminations.

5. The antenna assembly described in claim 4, wherein said plural intersecting radiating slots consist of two orthogonally intersecting radiating slots, each said slot having a symmetrically stepped increase in width at the locus of intersection.

6. The antenna assembly described in claim 5, wherein said first resonant cavity additionally comprises within said cavity a plurality of ridges disposed symmetrically with respect to said orthogonally intersecting radiating slots.

7. The antenna assembly described in claim 5, wherein the perimeter of said first resonant cavity is defined by at least one side wall and wherein said plural intersecting radiating slots are linear and extend over the edge of the perimeter of said first wall into said side wall.

8. The antenna assembly described in claim 7, wherein said first resonant cavity additionally comprises within said cavity a plurality of ridges disposed symmetrically with respect to said orthogonally intersecting radiating slots.

* * * * *